US008517555B1

(12) United States Patent
LeJeune

(10) Patent No.: US 8,517,555 B1
(45) Date of Patent: Aug. 27, 2013

(54) ILLUMINATED WALKING CANE

(76) Inventor: Francis E. LeJeune, River Ridge, LA (US)

( * ) Notice: Subject to any disclaimer, the term of this patent is extended or adjusted under 35 U.S.C. 154(b) by 0 days.

(21) Appl. No.: 13/553,191

(22) Filed: Jul. 19, 2012

Related U.S. Application Data

(60) Provisional application No. 61/509,384, filed on Jul. 19, 2011.

(51) Int. Cl.
*A45B 3/02* (2006.01)

(52) U.S. Cl.
USPC ..... 362/102; 135/76; 135/65

(58) Field of Classification Search
USPC ..... 362/102; 135/65, 76, 910
See application file for complete search history.

(56) References Cited

U.S. PATENT DOCUMENTS 4,013,881 A 3/1977 Sargent
4,837,666 A * 6/1989 Conkle ..... 362/102
5,575,294 A * 11/1996 Perry et al. ..... 600/587
5,810,466 A * 9/1998 Young ..... 362/102
6,145,993 A 11/2000 Filippino
6,394,116 B1 5/2002 Winn
2002/0189657 A1 * 12/2002 Yuan ..... 135/65

* cited by examiner

*Primary Examiner* — Mary Ellen Bowman
(74) *Attorney, Agent, or Firm* — Garvey, Smith, Nehrbass & North, L.L.C.; Charles C. Garvey, Jr.; Vanessa M. D'Souza

(57) ABSTRACT

A walking cane apparatus provides an elongated translucent or transparent shaft and a handle fitted to an upper end portion of the shaft, the handle having an extended open ended bore that is sized and shaped to fit the outside surface of the shaft. A flashlight is removably connectable to the combination of handle and shaft and in the bore of the handle, wherein an illuminated end portion of the flashlight registers upon the upper end portion of the shaft. Illumination from the flashlight shines downwardly to the lower end portion of the shaft where an exposed illuminating surface receives light from the flashlight for projecting to a walking surface. A part of the flashlight extends from the handle for switching the flashlight on or off or for removing the flashlight so that it can be used separate from the cane to illuminate a door lock or other object.

21 Claims, 3 Drawing Sheets

ILLUMINATED WALKING CANE

CROSS-REFERENCE TO RELATED APPLICATIONS

This is a non provisional patent application of U.S. Provisional Patent Application Ser. No. 61/509,384, filed Jul. 19, 2011.

Priority of U.S. Provisional Patent Application Ser. No. 61/509,384, filed Jul. 19, 2011, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to walking canes and more particularly to an illuminated improved walking cane that secures a removable flashlight to the upper end of an elongated transparent or translucent shaft that can be illuminated with the flashlight to cast light upon an underlying floor, wherein the flashlight extends through a handle, protruding upwardly through the top of the handle so that a user can switch the flashlight on or off and/or remove the flashlight so that it can be used separate from the cane.

2. General Background of the Invention

Several patents have issued for illuminated walking canes. The following table gives examples.

| U.S. Pat. No. | Title | Inventor | Issue Date |
|---|---|---|---|
| 4,013,881 | Safety Signal Cane | Otto Sargent | Mar. 22, 1977 |
| 6,145,993 | Illuminated Cane Tip | Frank Fillppino | Nov. 14, 2000 |
| 6,394,116 | Illuminated Walking Assistance Apparatus | Ray Winn | May 28, 2002 |

BRIEF SUMMARY OF THE INVENTION

The present invention provides an improved illuminated walking cane that employs a removable flashlight that can align (e.g., generally vertically) with the shaft of the cane, an end portion of the flashlight extending through the handle of the cane and upwardly above the handle of the cane so that user can switch the flashlight between illuminated and off positions. The user can remove the flashlight so that it can be used apart from the cane such as when a user approaches his or her door and wants to see the door handle or the door lock more clearly.

The present invention employs an elongated shaft of transparent or translucent material such as Lucite. A lower end portion of the shaft is fitted with a foot (e.g., rubber or polymeric) that has an opening so that lumination from the flashlight travels through the transparent or translucent shaft to the lower end portion of the shaft and through an opening at the bottom of the foot. Thus, when the flashlight is installed in the cane handle, it illuminates the shaft and shines light through the opening in the bottom of the foot to the floor or other walking surface thus aiding the user to see more clearly.

When a user reaches his or her doorway or the doorway of an automobile or other destination, the flashlight can be separated from the cane. The user can then employ the flashlight to illuminate the door knob, door lock, car lock, or the like.

The present invention includes a walking cane apparatus comprising an elongated translucent or transparent shaft having upper and lower end portions; a handle fitted to the upper end portion of the shaft, the handle having an extended open ended bore that is sized and shaped to fit the outside surface of the shaft; a flashlight that is removably connectable to the combination of handle and shaft wherein in a connected position, the flashlight is sized and shaped to fit within the bore of the handle and wherein an illuminated end portion of the flashlight registers upon the upper end portion of the shaft so that illumination from the flashlight shines downwardly from the upper end portion of the shaft to the lower end portion of the shaft along a path generally aligned with the shaft; and the lower end portion of the shaft having an exposed illuminating surface that receives light from the flashlight for projecting to a walking surface such as a floor, driveway, or sidewalk.

Preferably, the upper end portion of the shaft provides a socket and the flashlight is sized and shaped to fit inside the socket.

Preferably, the flashlight forms a frictional fit with the socket.

Preferably, the flashlight is secured to the socket with a set screw.

Preferably, the flashlight can be switched on or off by twisting one part of the flashlight relative to another part of the flashlight.

Preferably, in the connected position, an exposed portion of the flashlight can be accessed by a user.

Preferably, the exposed portion of the flashlight has a switch that enables a user to illuminate the flashlight.

The present invention includes a walking cane apparatus comprising an elongated translucent shaft having upper and lower end portions; a handle fitted to the upper end portion of the shaft and having an upper bore and a lower bore, wherein the lower bore is sized and shaped to fit the outside surface of the upper end portion of the shaft and the upper bore extends into a socket of the upper end portion of the shaft; a flashlight that is removably connectable to the handle and the shaft, wherein the upper bore and socket are sized and shaped to fit the lower end portion of the flashlight; and the lower end portion of the flashlight having a light member that illuminates the shaft by directing light from the upper end portion of the shaft to the lower end portion of the shaft along a path generally aligned with the shaft, and the light member further illuminating a walking surface by directing light downwardly from the lower end portion of the shaft through an opening.

Preferably, the flashlight is connected by a securing mechanism.

Preferably, the securing mechanism is a foam bushing or sleeve.

Preferably, the securing mechanism is a rubber bushing or sleeve.

Preferably, the securing mechanism is a screw.

Preferably, the flashlight is used separately from the handle and shaft.

Preferably, the upper end portion of the flashlight extends above the upper surface of the handle.

Preferably, the flashlight can be turned off and on at the upper end portion of the flashlight.

Preferably, the upper end portion of the flashlight extends above the handle.

The present invention includes a multi-use sight aid apparatus, comprising a cane having an elongated translucent shaft having upper and lower end portions, a handle fitted to the upper end portion of the shaft, and a bore extending from the upper surface of the handle into a socket of the upper end portion of the shaft; a flashlight having an upper and lower end portions and light member; and a securing mechanism located in the bore and cooperating with the handle to define a fit with the flashlight to detachably couple the flashlight to the cane.

Preferably, the lower end portion of the flashlight illuminates the shaft by directing light along a path generally aligned with the shaft from the upper end portion of the shaft to the lower end portion of the shaft, and further illuminating a walking surface by directing light downwardly from the lower end portion of the shaft through an opening.

Preferably, the securing mechanism is a foam bushing or sleeve.

Preferably, the securing mechanism is a rubber bushing or sleeve.

Preferably, the securing mechanism is a screw.

Preferably, the upper end portion of the flashlight extends above the upper surface of the handle.

Preferably, the flashlight can be turned off and on at the upper end portion of the flashlight.

Preferably, batteries are housed in the flashlight.

A walking cane apparatus provides elongated translucent or transparent shaft (e.g. Lucite) having upper and lower end portions. A handle is fitted to the upper end portion of the shaft, the handle having an extended open ended bore that is sized and shaped to fit the outside surface of the shaft. A flashlight (e.g. Mini Maglite) is removably connectable to the combination of handle and shaft wherein in a connected position, the flashlight is sized and shaped to fit within the bore of the handle and wherein an illuminated end portion of the flashlight registers upon the upper end portion of the shaft. In this fashion, illumination from the flashlight shines downwardly from the upper end portion of the shaft to the lower end portion of the shaft. The lower end portion of the shaft has an exposed illuminating surface that receives light from the flashlight for projecting to a walking surface such as a floor, driveway, or sidewalk. A part of the flashlight extends from the handle so that it can be manipulated such as for switching the flashlight on or off or for removing the flashlight so that it can be used separate from the cane such as to illuminate a door lock or other object for a user.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
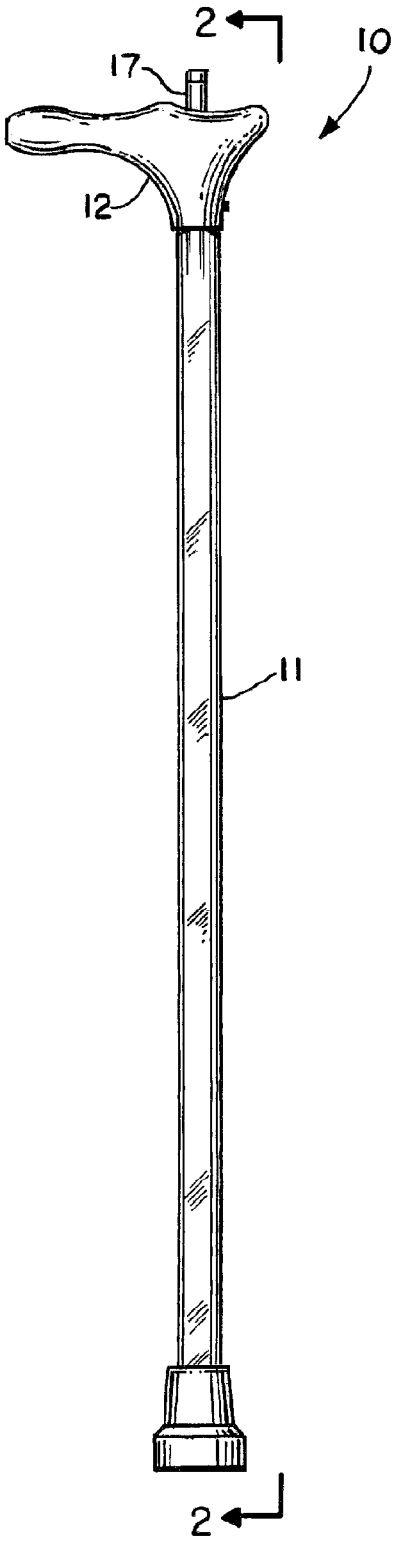
FIG. 1 is a side, elevation view of a preferred embodiment of the apparatus of the present invention.
Figure 2:
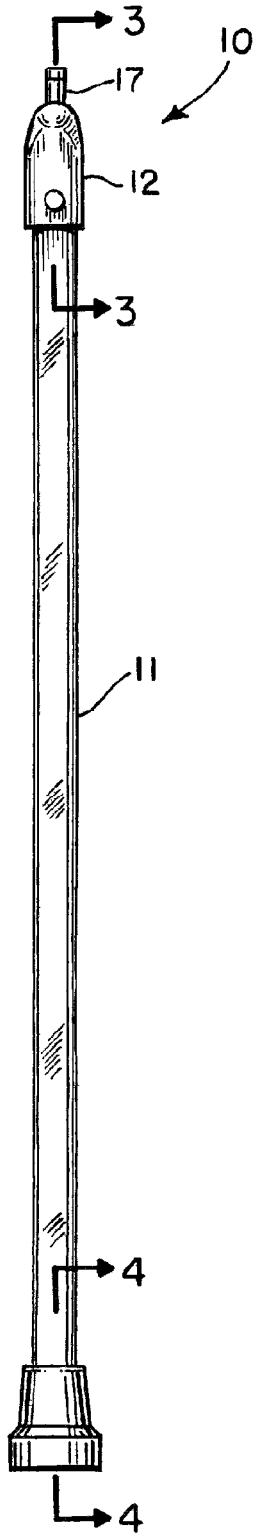
FIG. 2 is a side elevation view of a preferred embodiment of the apparatus of the present invention, taken along lines 2-2 of FIG. 1.

FIGS. 1-5 and 8 show a preferred embodiment of the apparatus of the present invention designed generally by the numeral 10. Walking cane 10 employs an elongated shaft 11 such as a cylindrically shaped shaft of translucent or transparent material such as a Lucite shaft. The cane 10 has an upper end portion 12 that can be provided with a cylindrically shaped opening or socket 13 that is receptive of a standard flashlight 17. The shaft 11 can be about 2.5-3.5 feet long as an example. The shaft 11 can be about ⅞ inches in diameter as an example. The lower end portion 14 of the cane 10 is fitted with a foot 15 which can be of a polymeric or rubber material. The foot 15 has an opening 16 through which light can shine when the flashlight 17 is illuminated.

Figure 3:
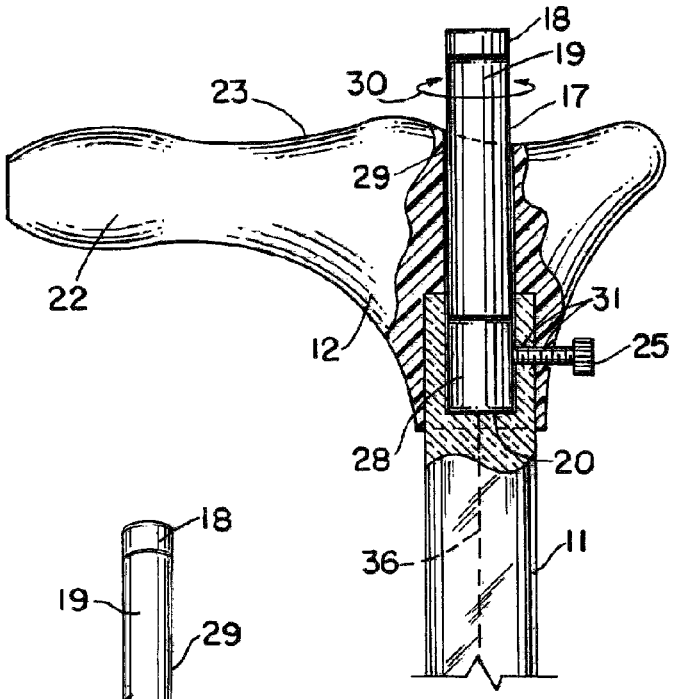
FIG. 3 is a partial sectional view taken alone lines 3-3 of FIG. 2.

Flashlight 17 can be generally cylindrically shaped. Flashlight 17 can be any commercially available flashlight such as any model flashlight manufactured and sold under the trademark "MAGLITE"®. Suitable flashlights 17 could for example include the MAGLITE® Excel 100 LED, Mini MAGLITE®, Mini MAGLITE® LED, MAGLITE Solitaire® as examples. Batteries, a light bulb, a switch and conducting wires can be housed within flashlight 17. Flashlight 17 can preferably be provided with an end cap 18 which would be removable from flashlight body 19 for inserting or removing batteries. Flashlight 17 provides an illuminated end portion 20 that provides an illuminating member, such as a bulb, LED, or the like. The flashlight 17 has the ability of generate a light beam along a path 36. In FIG. 3, the illuminated end portion 20 directs light along a path generally aligned with shaft 11, as indicated by line 36.

Figure 8:
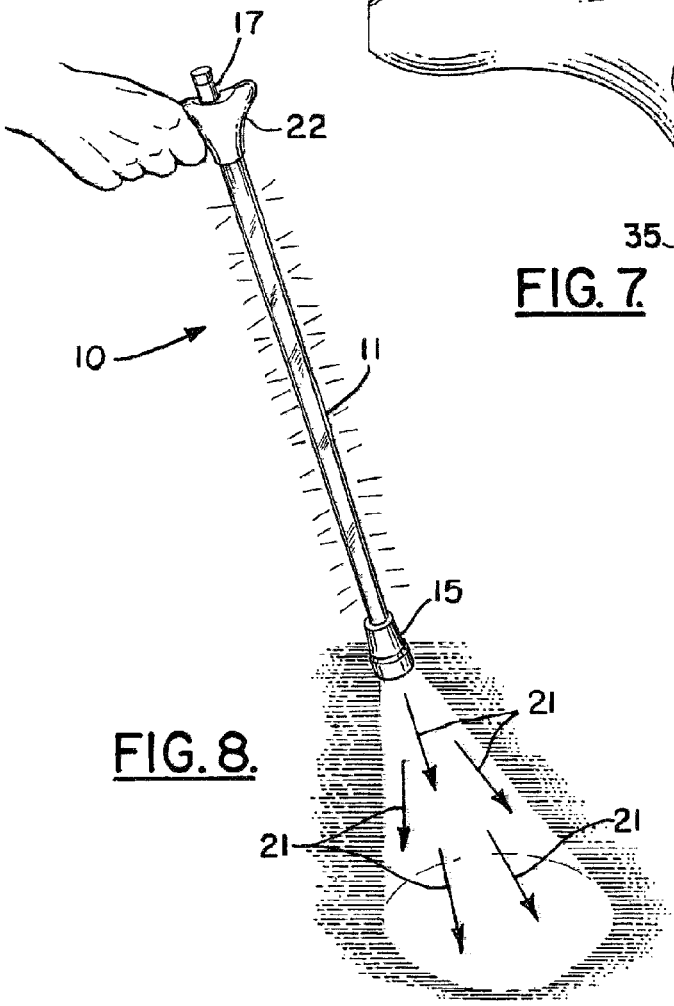
FIG. 8 is a perspective view of a preferred embodiment of the apparatus of the present invention.

In FIG. 8, arrows 21 designate the direction of illumination of light from flashlight 17 when the switch of the flashlight is used to activate the flashlight 17 moved to an "on" position. Illumination of light from the flashlight 17 can for example be directed downwards. Illumination of light from the flashlight 17 can for example be directed multi-directional. It should be understood that the switch to illuminate the flashlight 17 could be by means such as rotating one part of the flashlight relative to the other, a button, a slide, or any other switch known in the art. Some flashlights, such as the Mini MAGLITE® are switched "on" or "off" by rotating one section 28 relative to another section 29 as indicated by arrow 30 in FIG. 3. Flashlight 17 can be held in place by a set-screw, set knob, frictional fit, threaded fit, cylindrically shaped rubber or polymeric bushing, adhesive, or other such connection. Set screw 25 threadably engages an internally threaded opening or socket 31 so that rotation of set screw 25 enables set screw 25 to selectively engage and grip or release flashlight 17 body 19, depending upon the direction of rotation of the set screw 25.

Handle 22 provides an upper surface or upper portion 23 that would be typically grasped by the palm of a user when manipulating the cane 10. Handle 22 provides an upper surface 23 and a socket or bore 24 that extends to the upper surface 23, communicating with opening 13. In this fashion, the flashlight 17 can extend into the opening 13 and bore 24. Flashlight 17 extends in part above upper surface 23 as shown in FIG. 3. In this fashion, a portion of the flashlight 17 body 19 extends above the surface 23 so that a user can twist the flashlight 17 to turn it on or off or access a button or slide or other switch on the flashlight body 17. The exposed part of the flashlight 17 seen in FIG. 3 would be used to move the flashlight switching device between illuminating and off positions. For the Mini MAGLITE® flashlight 17, a twisting motion would be applied to the upper section 29 of the body 19 that extends above the surface 23 in FIG. 3 in order to either activate or deactivate the bulb or LED and thus the illumination. Set screw 25 would clamp the lower section 28.

Figure 5:
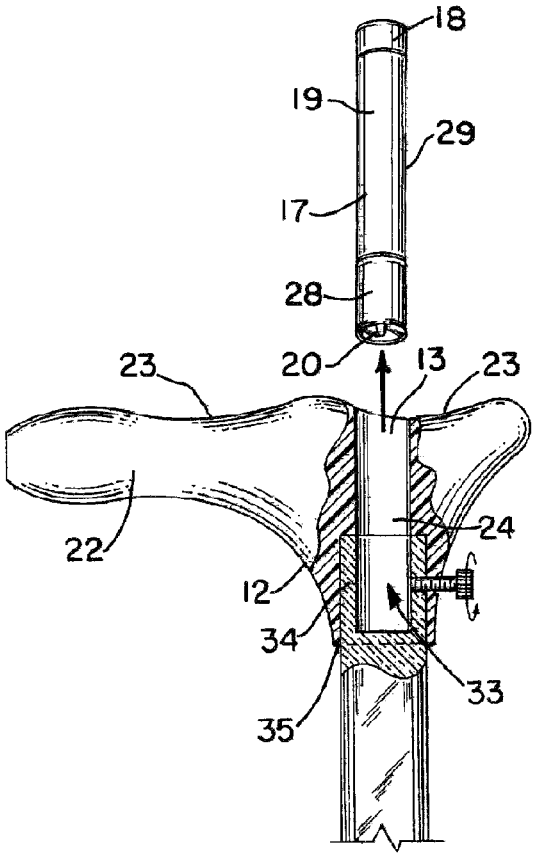
FIG. 5 is a fragmentary sectional view of a preferred embodiment of the apparatus of the present invention.
Figure 4:
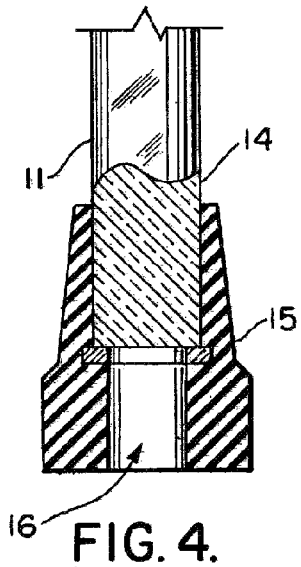
FIG. 4 is a partial sectional view, taken along lines 4-4 of FIG. 2.

Handle 22 can be secured to shaft 11 at surface 35. Shaft 11 can extend into bore or socket 34 of handle 22 for example as seen in FIGS. 3 and 5. Handle 22 could be secured to shaft 11 by any suitable means such as for example a set screw, set knob, frictional fit, threaded fit, cylindrically shaped rubber or polymeric bushing, adhesive, or other such connection. The set screw 25 could be simply loosened in order to remove the flashlight 17 if the user wanted to obtain full access to the flashlight 17 such as for purposes of servicing it, or using it to find objects such as keys. Upper end portion of shaft 11 can include socket or bore 33. Bore 24 can extend in socket 33 of shaft 11. Flashlight 17 can extend into the opening 13 and bore 24 of handle 22 and socket 33 of shaft 11.

Figure 6:
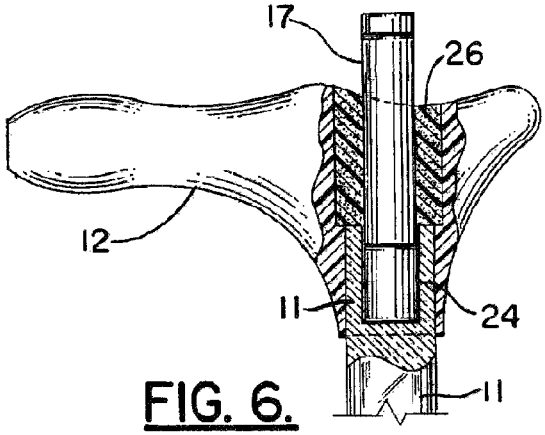
FIGS. 6-7 are sectional views of an alternate embodiment of the apparatus of the present invention.
Figure 7:
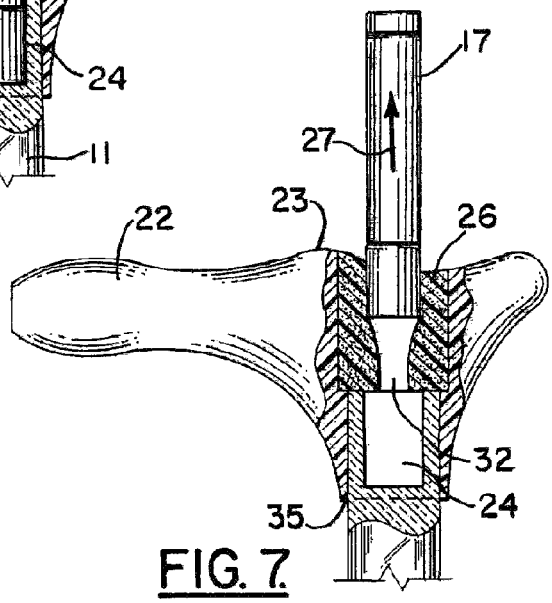

In FIGS. 6-7, an alternate embodiment is shown wherein the socket 24 is fitted with a cylindrically shaped (e.g., foam or rubber) bushing or sleeve so that a friction fit could be formed between the flashlight 17 and the sleeve 26.

In FIGS. 6-7, the bore 32 of sleeve 26 could be sized and shaped to closely fit the outside surface of the body 19 of flashlight 17. For example, bore 32 could be of a diameter or transverse cross section that is smaller than the diameter or transverse cross section of flashlight 17. The illuminated end 20 of the flashlight 17 could be of a larger diameter than bore 32 diameter so that the flashlight 17 could not be removed unless the frictional force holding the flashlight 17 to the sleeve 26 were overcome.

The flashlight 17 could thus form a frictional fit with the sleeve 26. In such a case, a user could remove the flashlight 17 by simply pulling it upwardly in the direction of arrow 27 in FIG. 7, overcoming the frictional fit between the flashlight 17 body 19 and the rubber or polymeric sleeve 26 that occupies the socket 13, 24. Such a sleeve 26 could be removable from the socket 13, 24 or could be permanently attached to the socket 13, 24 using an adhesive for example. The handle 22 could be of any suitable material such as wood, plastic or metal.

PARTS LIST

The following is a list of parts and materials suitable for use in the present invention:

| PARTS NO. | DESCRIPTION |
|---|---|
| 10 | walking cane |
| 11 | transparent shaft |
| 12 | upper end |
| 13 | socket/opening |
| 14 | lower end |
| 15 | foot |
| 16 | opening |
| 17 | flashlight |
| 18 | end cap |
| 19 | body |
| 20 | illuminated end/bulb |
| 21 | arrow |
| 22 | handle |
| 23 | upper surface |
| 24 | open ended bore |
| 25 | set screw |
| 26 | sleeve |

-continued

| PARTS NO. | DESCRIPTION |
|---|---|
| 27 | arrow |
| 28 | section |
| 29 | section |
| 30 | arrow |
| 31 | internally threaded socket |
| 32 | bore/socket |
| 33 | bore/socket |
| 34 | bore/socket |
| 35 | surface |
| 36 | line/light path |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A walking cane apparatus comprising:

a) an elongated translucent or transparent shaft having upper and lower end portions;

b) a handle fitted to the upper end portion of the shaft, the handle having an extended open ended bore that is sized and shaped to fit the outside surface of the shaft;

c) a flashlight that is removably connectable to the combination of handle and shaft wherein in a connected position, the flashlight is sized and shaped to fit within the bore of the handle and wherein an illuminated end portion of the flashlight registers upon the upper end portion of the shaft so that illumination from the flashlight shines downwardly from the upper end portion of the shaft to the lower end portion of the shaft along a path generally aligned with the shaft; and d) the lower end portion of the shaft having an exposed illuminating surface that receives light from the flashlight for projecting to a walking surface such as a floor, driveway, or sidewalk.

2. The apparatus of claim 1 wherein the upper end portion of the shaft provides a socket and the flashlight is sized and shaped to fit inside the socket.

3. The apparatus of claim 2 wherein the flashlight forms a frictional fit with the socket.

4. The apparatus of claim 2 wherein the flashlight is secured to the socket with a set screw.

5. The apparatus of claim 1 wherein the flashlight can be switched on or off by twisting one part of the flashlight relative to another part of the flashlight.

6. The apparatus of claim 1 wherein in the connected position, an exposed portion of the flashlight can be accessed by a user.

7. The apparatus of claim 6 wherein the exposed portion of the flashlight has a switch that enables a user to illuminate the flashlight.

8. A walking cane apparatus comprising:

a) an elongated translucent shaft having upper and lower end portions;

b) a handle fitted to the upper end portion of the shaft and having an upper bore and a lower bore, wherein the lower bore is sized and shaped to fit the outside surface of the upper end portion of the shaft and the upper bore extends into a socket of the upper end portion of the shaft;

c) a flashlight that is removably connectable to the handle and the shaft, wherein the upper bore and socket are sized and shaped to fit the lower end portion of the flashlight; and d) the lower end portion of the flashlight having a light member that illuminates the shaft by directing light from the upper end portion of the shaft to the lower end portion of the shaft along a path generally aligned with the shaft, and the light member further illuminating a walking surface by directing light downwardly from the lower end portion of the shaft through an opening.

9. The apparatus of claim 8, wherein the flashlight is connected by a securing mechanism.

10. The apparatus of claim 9, wherein the securing mechanism is a foam bushing or sleeve.

11. The apparatus of claim 9, wherein the securing mechanism is a rubber bushing or sleeve.

12. The apparatus of claim 9, wherein the securing mechanism is a screw.

13. The apparatus of claim 8, wherein the flashlight is used separately from the handle and shaft.

14. The apparatus of claim 8, wherein the upper end portion of the flashlight extends above the upper surface of the handle.

15. The apparatus of claim 14, wherein the flashlight can be turned off and on at the upper end portion of the flashlight.

16. The apparatus of claim 8, wherein the upper end portion of the flashlight extends above the handle.

17. A multi-use sight aid apparatus, comprising:

a) a cane having an elongated translucent shaft having upper and lower end portions, a handle fitted to the upper end portion of the shaft, and a bore extending from the upper surface of the handle into a socket of the upper end portion of the shaft;

b) a flashlight having an upper and lower end portions and light member; and c) a securing mechanism located in the bore and cooperating with the handle to define a connection with the flashlight that detachably couples the flashlight to the cane.

18. The apparatus of claim 17, wherein the lower end portion of the flashlight illuminates the shaft by directing light along a path generally aligned with the shaft from the upper end portion of the shaft to the lower end portion of the shaft, and further illuminating a walking surface by directing light downwardly from the lower end portion of the shaft through an opening.

19. The apparatus of claim 17, wherein the securing mechanism is a sleeve.

20. The apparatus of claim 17, wherein the securing mechanism includes a set screw.

21. The apparatus of claim 17, wherein the upper end portion of the flashlight extends above the upper surface of the handle.

* * * * *